US005890936A

United States Patent [19]

McDonald et al.

[11] Patent Number: 5,890,936

[45] Date of Patent: Apr. 6, 1999

[54] ELECTRICAL TERMINAL

[75] Inventors: John J. McDonald, Albion, Ind.; Robert Colantuono, Ypsilanti, Mich.; George E. Hyde, Wayne; Von R. Pogue, Huntington, both of Ind.

[73] Assignee: UT Automotive Dearborn, Inc., Dearborn, Mich.

[21] Appl. No.: 731,636

[22] Filed: Oct. 15, 1996

[51] Int. Cl.[6] ..... H01R 11/22

[52] U.S. Cl. ..... 439/852

[58] Field of Search ..... 439/842, 843, 439/845, 850–852, 856

[56] References Cited

U.S. PATENT DOCUMENTS

| | | | |
|---|---|---|---|
| 3,614,716 | 10/1971 | Jensik | 439/851 |
| 3,786,401 | 1/1974 | Jones et al. | 439/852 |
| 3,818,424 | 6/1974 | Evans | 439/852 |
| 5,269,712 | 12/1993 | Denlinger et al. | 439/845 |
| 5,529,517 | 6/1996 | Hopf et al. | 439/843 |
| 5,551,897 | 9/1996 | Alwine | 439/843 |
| 5,755,599 | 5/1998 | Hotea | 439/745 |

FOREIGN PATENT DOCUMENTS

| | | | |
|---|---|---|---|
| 2406215 | 9/1974 | Germany | 439/842 |

*Primary Examiner*—Gary Paumen
*Assistant Examiner*—Tho D. Ta
*Attorney, Agent, or Firm*—Howard & Howard

[57] ABSTRACT

An electrical terminal, particularly for use in automotive applications, includes a body portion electrically connected to a wire connection portion. The body portion has an entry end, an exit end and an interior chamber therebetween. The body portion further has at least three spring members within the interior chamber for holding a blade member in electrical contact with the wire connection portion. The spring members are integral with the body portion and extend rearwardly and inwardly within the interior chamber.

12 Claims, 2 Drawing Sheets

ELECTRICAL TERMINAL

TECHNICAL FIELD

The present application relates to electrical connector systems and more particularly, to an improved female terminal for the connector systems.

BACKGROUND OF THE INVENTION

Electrical connector systems are used in a wide variety of applications, such as in wire harnesses. Wire harnesses are large bundles of wire used to interconnect the electrical components of a vehicle to their respective controls and a power source. Generally, the connector systems include male blade members, female electrical terminals, and connectors.

The male blade members and female electrical terminals, grip the wires respectively, and mate to electrically interconnect the wires. The blades and terminals are held within mating connectors. Since the harness environment includes corrosive chemicals, flying objects, and high temperatures, that might damage them, the connectors also protect the blades and terminals.

The female terminals typically have four side walls folded in a box-like manner having a wire connection portion electrically connected thereto. The wire connection portion is crimped onto the wire. Conventional female terminals have one or two flexible spring members which project into the box and are formed integral with the walls of the box. The spring members have one or more pivot points, so that upon insertion of the blade member the spring members flex to allow entry the blade members into the box and hold the blade member therein.

Conventional female terminals have several limitations when used in, for example, automotive applications. For automotive applications as a result of the needs of the electrical system of the vehicle and limited space, it is necessary for the terminals to carry up to 5 Amps of current in as small and light weight a terminal as possible.

Furthermore, a number of blades and terminals are usually held by separate connectors. In order for the components to mate, their respective connectors must be joined properly. The insertion force necessary for one male blade to enter a female terminal will increase proportionally when the number of blades held by the connector increases. In an effort to make assembly as easy as possible, it is desired that the terminals have a low insertion force.

Having a plurality of terminals in close proximity allows electrical interference between the terminals. This occurs when the signals from one terminal leak into another terminal because of capacitance or inductive coupling or both. As a result, the signal integrity degrades, which is evidenced by undesirable noise or static.

What is therefore needed in the art is an improved female electrical terminal exhibiting adequate current capacity in a small terminal. The terminal should also have a robust design, requiring low insertion forces of a male blade member, and minimizing electrical interference.

SUMMARY

An electrical terminal, particularly for use in automotive applications, includes a body portion electrically connected to a wire connection portion. The body portion has an entry end, an exit end and an interior chamber therebetween. The body portion further has at least three spring members within the interior chamber for holding a blade member in electrical contact with the wire connection portion. The spring members are integral with the body portion and extend rearwardly and inwardly within the interior chamber. Using at least three spring members allows increased current capacity in a smaller terminal.

The foregoing invention will become more apparent in the following detailed description of the best mode for carrying out the invention and in the accompanying drawings.

These figures are meant to be exemplary and not to limit the generally broad scope of the present invention.

BEST MODE FOR CARRYING OUT AN EMBODIMENT OF THE INVENTION

Figure 1:
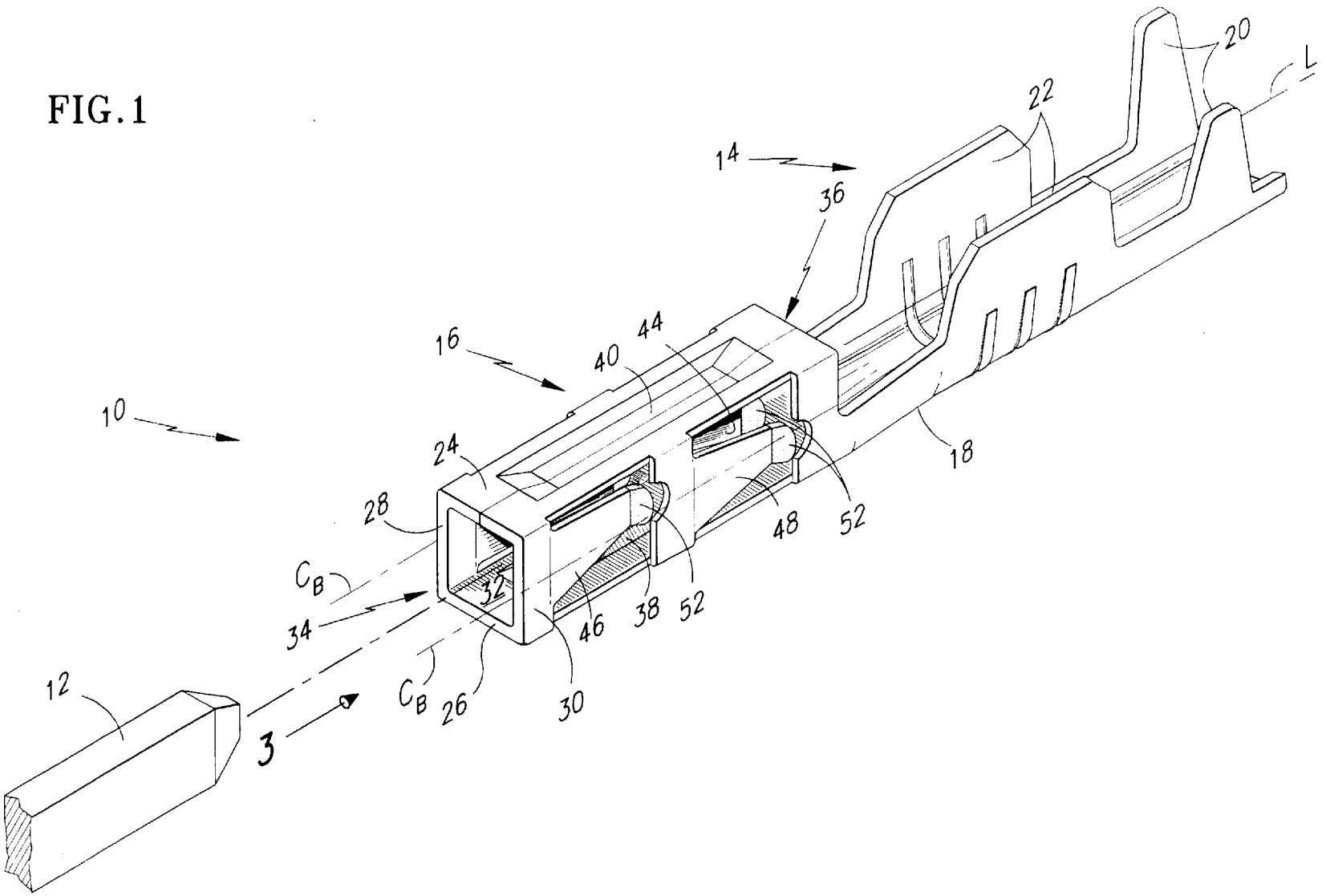
FIG. 1 is a perspective view of one embodiment of a female terminal of the present invention.

Referring to FIG. 1, a female electrical terminal 10 is operatively associated with a male blade member 12. The female terminal 10 includes a wire connection portion 14 and a body portion 16.

The wire connection portion includes a base 18, a first set of wire tabs 20, and a second set of wire tabs 22. The wire tabs 20 and 22 extend from the base 18, and are initially set in an open configuration. The tabs if closed, operate to hold an electrically conductive wire (not shown) in electrical contact with the base 18 as is known in the art.

The body portion 16 is preferably box-shaped and formed by integral first, second, third and fourth walls 24, 26, 28, and 30. The first and second walls 24 and 26 are substantially parallel, and spaced from one another. The third and fourth walls 28 and 30 are substantially parallel, and spaced from one another, so that these walls 28 and 30 join the first and second walls 24 and 26 together. The walls 24, 26, 28 and 30 define an interior chamber 32.

The body portion 16 further includes an entry end 34, an opposed exit end 36, a longitudinal axis L, and a center line $C_B$. The longitudinal axis L extends in the direction from the entry end 34 to the exit end 36. The body center line $C_B$ is disposed at the midpoint along the width of the third and fourth walls 28 and 30.

Figure 3:
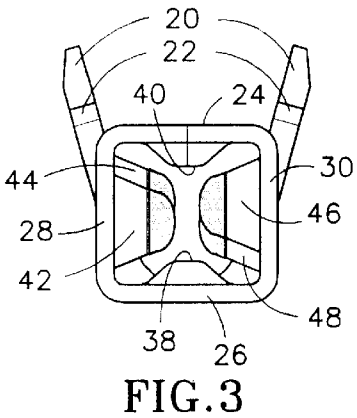
FIG. 3 is a left side view along line 3 of FIG. 1 of the female terminal.
Figure 2:
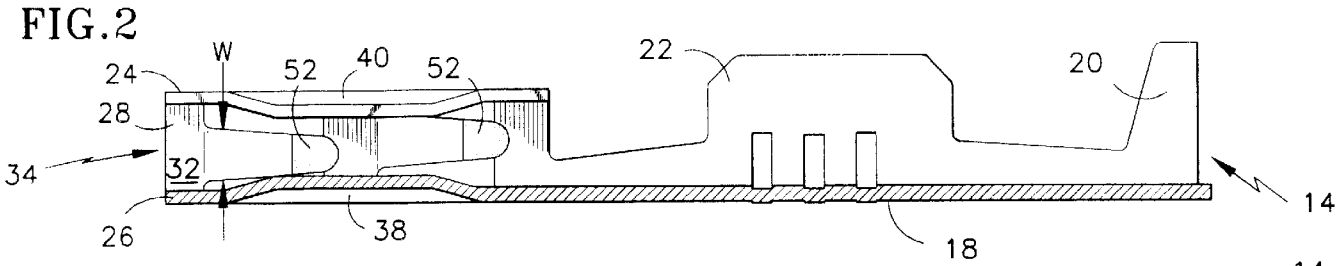
FIG. 2 is a front view of the female terminal of FIG. 1.

Referring to FIGS. 2 and 3, the second wall 26 is adjacent to and integral with the base 18 of the wire connection portion 14. The first and second walls 24 and 26 include contact surfaces 38 and 40, respectively. The contact surfaces 38 and 40 protrude into the interior chamber 32, and extend along the longitudinal axis L. The surfaces 38 and 40 are preferably singular ridge shaped members.

Figure 4:
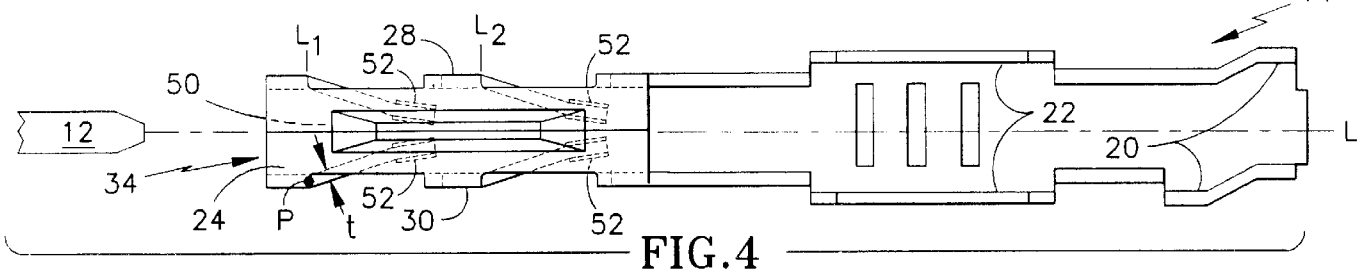
FIG. 4 is a top view of the female terminal of FIG. 1.

Referring to FIG. 1 and 4, the third and fourth walls 28 and 30 each include two spring members integrally formed therewith. The spring members extend rearwardly, and are bent to extend into the interior chamber 32 of the body portion 16.

As can be clearly appreciated from FIG. 4, the spring members in the relaxed positions do not cross a central plane defined intermediate the spaced walls of said body portion. Thus, in the relaxed position the spring members are spaced on either side of the central plane.

The spring members 42 and 44 extend from a first longitudinal position $L_1$ near the entry end 32 of the body portion 16. The spring members 46 and 48 extend from a second longitudinal position $L_2$ between the entry and exit ends 32 and 34 of the body portion 16. The third wall spring members 42 and 44 and the fourth wall spring members 46 and 48 extend toward one another to form a pathway 50 therebetween. As illustrated with the spring member 42 each spring member has a single pivot point P.

Figure 5:
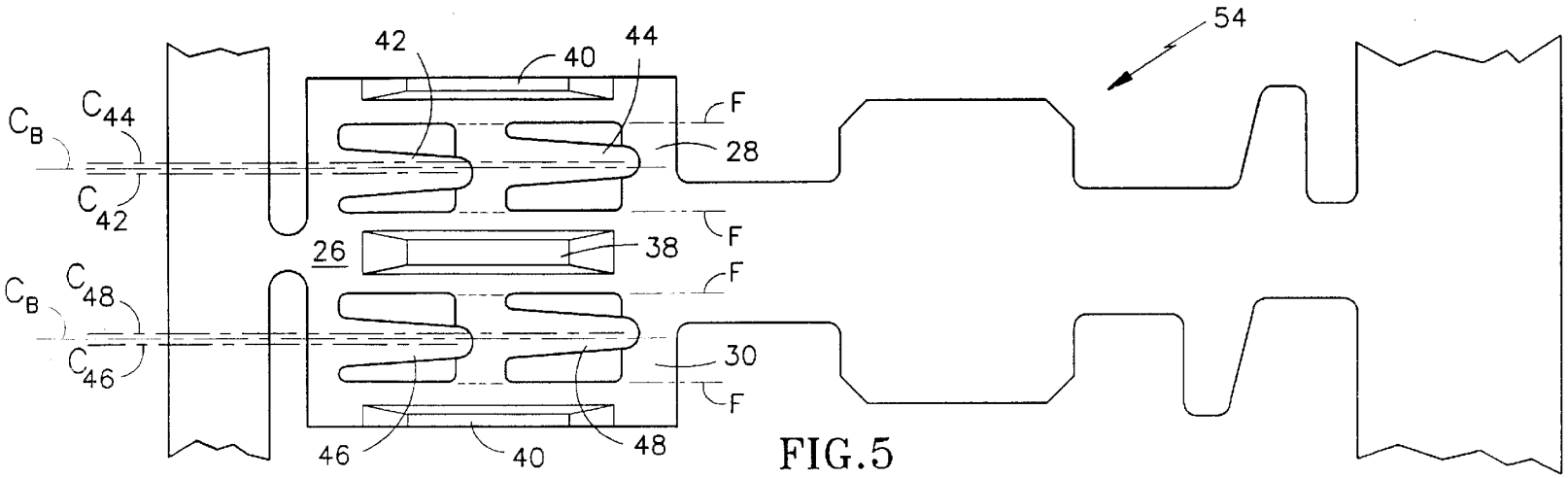
FIG. 5 is a top view of a sheet metal blank from which the female terminal of FIG. 1 is formed.

Referring to FIG. 5, each spring member 42, 44, 46, and 48 includes a center line $C_{42}$, $C_{44}$, $C_{46}$ and $C_{48}$ disposed halfway along the width of the spring members, respectively. Each spring member is formed so that its centerline is spaced from the centerline of the body portion $C_B$. The third wall spring members 42 and 44 are offset in opposite directions with respect to the centerline $C_B$. The fourth wall spring members 46 and 48 are offset in opposite directions with respect to the centerline $C_B$. Referring to FIG. 3, the third wall spring members 42 and 44 are offset in a reverse fashion to the fourth wall spring members 46 and 48.

Referring to FIG. 2, each spring member further includes a tip 52 disposed at the free end of each spring member. The tip 52 is formed by metal plating. It is preferred that the tips be shaped like a dome to minimize the hertz stress when the blade member is inserted. It is recommended that the plating be made of precious metals, such as gold, or semi-precious metals.

Referring to FIG. 2, the spring members have a width, represented by the letter w, which is tapered. In other embodiments the width may not be tapered. Referring to FIG. 2, the spring members have a thickness, represented by the letter t. The thickness may vary along the length. Both width and thickness variations are designed to change capacitance and/or impedance to reduce signal degradation during operation.

Use of the terminal will now be discussed. Referring to FIGS. 1 and 4, upon insertion of the blade member 12 into the entry end 34 of the terminal 10, it contacts the spring members 42 and 46. Since the spring members 42 and 46 are disposed within the pathway 50 of the blade member 12, and fixed at one end, the blade member 12 causes the spring members 42 and 46 to flex toward the third and fourth walls 28 and 30 respectively. The spring members are bent so that upon forming the body portion, the spring members will be resiliently biased therein. The spring members pivot about their pivot point P. When the blade member 12 is further inserted into the pathway 50, the blade member 12 contacts the spring members 44 and 48. These spring members 46 and 48 also flex toward the third and fourth walls 28 and 30, respectively.

The spring members 42, 44, 46, and 48 are formed so that the tips 52 (as shown in FIGS. 2 and 4) will interfere with the third and fourth walls 28 and 30 to limit their flexure. Upon full insertion the spring members exert a normal force on the blade member 12, thus retaining the blade member 12 within the terminal 10. The blade member 12 is in contact with the contact surfaces 38 and 40 (as shown in FIG. 4) and tips 52, so that the blade member is electrically connected to the wire connection portion 14 via the body portion 16 and the base 18. Thus, in operation current or signals may be carried from the terminal wire (not shown) to a blade member wire (not shown). Upon removal of the blade member, the spring members return to their original positions.

Proper operation of the terminal requires proper material selection, and terminal and blade geometry. All of the dimensions and geometric configurations have been experimentally determined. The principal advantage of the present invention is that a 0.635 mm terminal can carry up to 5 Amps of current. This is achieved by the number of spring members. By allowing more than two spring members the current can be split up into smaller amounts. As a result, the cross-sectional area of the spring members necessary to carry the current decreases, thus allowing for a smaller terminal. The size of the body portion cross sectional area allows for greater current capacity. Current capacity is also increased by selectively plating the tips of the spring members. As a result of dividing the current between the spring members and the walls the heat and load is distributed which reduce stress relaxation and hot spots on the terminal, which may cause the terminal to fail.

Another advantage of the present invention is signal noise may be reduced by offsetting the spring members, and vary the spring members' width and thickness. By breaking up the signal path, capacitance and/or impedance may be decreased, which will decrease the noise.

Yet another advantage of the terminal is that it requires low insertion forces and maintains high enough normal force on the blade member to retain it. Insertion and normal force is due to spring member geometry. The spring members exert a normal force on the blade member sufficient to electrically connect the blade with the wire connection portion. This electrical connection allows the current to flow between the male blade and the terminal wire. Having a sufficiently high normal force further helps decrease the chance of film build-up of moisture and oxides which can form at lower contact pressures and act to interrupt the current path. In addition, as the normal force decreases the sensitivity of the terminal to vibration increases which can disengage the blade member, thereby interrupting the current path, or at least causing a noisy circuit.

Another advantage of the present design is that it is durable. The durable design is achieved in part by having four-walls which protect the spring member from its environment, as well as, by forming the spring members so that the tips cannot be touched upon initial entry of the blade member. Since the spring members at the entry end are rearwardly extending and converging, the blade member need not inserted directly into the pathway and the spring members will guide the blade member into the pathway without damaging the tips.

Furthermore the terminal has good repeatability, which means the male blade to be inserted a number of cycles without causing fatigue of the spring members. It can be seen that upon removal of the male blade member the spring members return to their initial state. The ability of the spring members to return to initial state, substantially unharmed is due to the geometry of the terminal, as well as, the material used for the terminal. Both allow the design of the terminal to be within elastic limits thereby enabling the return of the spring members to their initial position. Particularly, forming the spring members so that they contact the walls upon flexure, thus the walls stop the outward movement of the spring members. This prevents over stress of the spring members which could lead to damaging the spring members thereby making the terminal useless.

The terminal of the present application is also advantageous because it operates well electrically due to the material selected for the terminal, and the contact surfaces. The contact surfaces allow the current path from the blade to the wire connection portion to be direct and uninterrupted. Material buildup on the seams between adjoining walls, can prevent the blade member from contacting the desired wall. Thus, use of the contact surfaces serves to ensure an electrical connection between the blade member and the body portion The contact surfaces also position the blade member, so that the spring members touch the blade member at a particular location. The location selected allows the spring members to exert the maximum normal force on the blade member. This positioning is particularly important with round blade members, because due to the shape of the blade member if the member is not properly positioned the beam deflection will be less which consequently will decrease the normal force.

It will be understood that various modifications may be made to the embodiments disclosed herein. For example, the electrical terminal may be manufactured by using more than one part, such as a component including the body-portion and the wire connection portion. Alternatively, the contact surfaces may be formed of two or more, substantially parallel, ridges. The terminal may be made without the contact surfaces.

Furthermore, the spring members of the present invention may be employed to retain fuses, metal frets, printed circuit board connectors, or any other electric current carrying member. A variety of materials may also be utilized and the insertion and removal forces may vary depending upon material selection. The number of spring members may vary to three or more than four. In addition the locations of the spring members may be moved to other walls or the longitudinal positions of the members can be altered so that the spring members are at staggered longitudinal locations. This may reduce the insertion force due to the male blade only contacting one spring member at a time instead of two. Furthermore, instead of tips the free end of each spring member may be bent.

Furthermore a locking mechanism can be incorporated into the design. For example, the walls may be modified so that the first, second and third walls are formed to have overlapping sections. Overlapping will allow the terminal body portion to be difficult to unfold or unlock. Therefore, the above description should not be construed as limiting, but merely as exemplifications preferred embodiments. Those skilled in the art will envision other modifications within the scope and spirit of the claims appended hereto.

We claim:

1. An electrical terminal comprising:

a wire connector portion electrically coupled to a body portion and at least three flexible spring members integral to said body portion and electrical coupled to said body portion;

said body portion defined by walls, said walls defining an interior chamber having an entry end and an exit end, at least two of said walls being generally parallel and spaced;

said spring members resiliently biased inwardly into said interior chamber and extending rearwardly toward said exit end, each of said spring members having a contact tip;

at least two of said spring members being substantially opposite each other with one in each of said two spaced walls, and spaced apart; and said flexible spring members formed integrally from said two spaced walls by deforming them inwardly from said two spaced walls.

2. An electrical terminal as recited in claim 1, wherein said spring members extend inwardly from one of said walls at a pivot point, said pivot point being defined intermediate said entry and exit ends.

3. An electrical terminal as recited in claim 1, further wherein said three spring members include a first spring member, a second spring member, a third spring member and there being a fourth spring member; said first, second and third spring member being substantially opposite each other and spaced apart, and said second spring member and said fourth spring member being substantially opposite each other and spaced apart.

4. An electrical terminal as recited in claim 3, wherein each of said spring members includes a pivot point;

said pivot point of said first spring member being positioned adjacent said entry end and said pivot point of said second spring member being positioned between said pivot point of said first spring member and said exit end; and said pivot point of said third spring member being positioned adjacent said entry end and said pivot point of said fourth spring member being positioned between said pivot point of said third spring member and said exit end.

5. An electrical terminal as recited in claim 4, wherein each of said spring members includes a spring member center line extending along a longitudinal axis of said spring member;

said center line of said first spring member and said center line of said fourth spring member being in a first plane;

said center line of said second spring member and said center line of said third spring member being in a second plane; and said first plane being different from said second plane.

6. An electrical terminal as recited in claim 1, wherein said contact tips are plated.

7. An electrical terminal as recited in claim 6, wherein said contact tips are plated with a semi-precious metal.

8. An electrical terminal as recited in claim 6, wherein said contact tips are plated with a precious metal.

9. An electrical terminal comprising:

a wire connection portion electrically coupled to a body portion;

said body portion defining an interior space, there being at least a pair of parallel spaced walls, said parallel spaced walls each receiving two flexible spring members deformed into said space from said walls, said spring members being deformed from a pivot end into said space, said pivot end being formed adjacent an entry end of said body portion, and said spring members extending inwardly in a relaxed position such that inner ends of said spring members do not cross a central plane of said space parallel to, and intermediate said walls, such that said spring members do not cross said central plane of said space.

10. An electrical terminal as recited in claim 9, wherein there are a pair of said spring members spaced about said central plane from a respective one of said spring members being substantially opposite each other and in said opposed wall.

11. An electrical connection comprising:

a male connector;

a female connector including a wire connector portion electrically coupled to a body portion and at least three flexible spring members integral to said body portion and electrically coupled to said body portion;

said body portion including an interior chamber having an entry end and an exit end;

said spring members resiliently biased inwardly into said interior chamber and extending rearwardly toward said exit end, each of said spring members having a contact tip;

said male connector comprising a blade, said blade adapted to be received through said entry end into said interior chamber, said contact tips contacting said blade to electrically couple said blade to said female connector;

said contact tips releasably maintaining said blade in said interior chamber;

said at least three flexible spring members including a first spring member, a second spring member, a third spring member, and there being a fourth spring member;

said first spring member and said third spring member being substantially opposite each other in spaced apart;

said second spring member and said fourth spring member being substantially opposite each other in spaced apart;

each of said spring members includes a pivot point;

said pivot point of said first spring member being positioned adjacent said entry end and said pivot point of said second spring member being positioned between said pivot point of said first spring member and said exit end;

said pivot point of said third spring member being positioned adjacent said entry end and said pivot point of said fourth spring member being positioned between said pivot point of said third spring member and said exit end;

each of said spring members includes a spring member center line extending along a longitudinal axis of said spring member;

said center line of said first spring member and said center line of said fourth spring member being in a first plane;

said center line of said second spring member and said center line of said third spring member being in a second plane; and said first plane being different from said second plane.

12. An electrical connection as recited in claim 11, wherein each of said spring members includes a pivot point;

said pivot point of said first spring member being positioned adjacent said entry end and said pivot point of said second spring member being positioned between said pivot point of said first spring member and said exit; end said pivot point of said third spring member being positioned adjacent said entry end and said pivot point of said fourth spring member being positioned between said pivot point of said third spring member and said exit end.

* * * * *